US010094396B2

(12) United States Patent
Song et al.

(10) Patent No.: US 10,094,396 B2
(45) Date of Patent: Oct. 9, 2018

(54) FAN HAVING COLD AIR FUNCTION

(71) Applicants: Jae Ha Song, Seoul (KR); Yu Jin Kim, Gyeonggi-do (KR); So Yeon Joo, Gyeonggi-do (KR)

(72) Inventors: Jae Ha Song, Seoul (KR); Yu Jin Kim, Gyeonggi-do (KR); So Yeon Joo, Gyeonggi-do (KR)

( * ) Notice: Subject to any disclaimer, the term of this patent is extended or adjusted under 35 U.S.C. 154(b) by 0 days.

(21) Appl. No.: 15/109,450

(22) PCT Filed: Jan. 2, 2015

(86) PCT No.: PCT/KR2015/000028
§ 371 (c)(1),
(2) Date: Jul. 1, 2016

(87) PCT Pub. No.: WO2015/102435
PCT Pub. Date: Jul. 9, 2015

(65) Prior Publication Data

US 2016/0327066 A1 Nov. 10, 2016

(30) Foreign Application Priority Data

Jan. 2, 2014 (KR) ..... 10-2014-0000029

(51) Int. Cl.
*F04D 29/70* (2006.01)
*F04D 25/08* (2006.01)
(Continued)

(52) U.S. Cl.
CPC ..... *F04D 29/705* (2013.01); *F04D 25/08* (2013.01); *F04D 27/006* (2013.01);
(Continued)

(58) Field of Classification Search
CPC .... F04D 29/701; F04D 29/703; F04D 29/705; F17C 9/04; F17C 2221/011
See application file for complete search history.

(56) References Cited

U.S. PATENT DOCUMENTS 5,136,852 A * 8/1992 Neeser ..... F17C 9/02 62/50.4
6,786,701 B1 * 9/2004 Huang ..... F04D 29/705 239/77
(Continued)

FOREIGN PATENT DOCUMENTS

CN 1177684 A 4/1998
CN 103758887 A 4/2014
(Continued)

OTHER PUBLICATIONS kr20-1999-0022967u Translation.*
kr20-0293688-y1 Translation.*

*Primary Examiner* — Brian King
(74) *Attorney, Agent, or Firm* — IP Legal Services, LLC

(57) ABSTRACT

The present invention relates to a fan with a cold air function which, through supply of liquid oxygen (LOX), has a strong cold air function and at the same time provides an air cleaning effect by supplying oxygen. A fan including a base part (10) equipped with a plurality of buttons (11), a main body part (20) installed on the top of the base part (10), a motor part (30), rotary blades (40) coupled to a motor shaft at the front of the motor part (30), and a protection net (50) installed to surround the rotor blades (40), the fan comprises: a mounting part (60) in which a liquid oxygen (LOX) charge canister (62) is removably mounted; an opening and closing controller (63) for controlling the output amount of an oxygen gas discharged from the charge canister (62) mounted in the mounting part (60); and a discharge pipe (64) which is connected to the opening and closing controller (63) and configured in such a manner that the discharged oxygen gas is diffused through the rotary blades (40) to the front.

4 Claims, 3 Drawing Sheets

(51) Int. Cl.
*F04D 29/58* (2006.01)
*F04D 27/00* (2006.01)
*F04D 29/32* (2006.01)

(52) U.S. Cl.
CPC ..... *F04D 29/325* (2013.01); *F04D 29/582* (2013.01); *F04D 29/703* (2013.01)

(56) References Cited

U.S. PATENT DOCUMENTS

| | | | | |
|---|---|---|---|---|
| 2009/0032982 | A1* | 2/2009 | Giacobbe | C21D 1/76 261/128 |
| 2013/0026664 | A1* | 1/2013 | Staniforth | F04D 25/08 261/24 |

FOREIGN PATENT DOCUMENTS

| | | | |
|---|---|---|---|
| CN | 203641327 | U | 6/2014 |
| DE | 19603975 | A1 | 7/1997 |
| KR | 10-1989-0000863 | A | 3/1989 |
| KR | 20-1989-0005078 | U | 4/1989 |
| KR | 20-0114832 | Y1 | 4/1998 |
| KR | 20-1999-0022967 | u * | 7/1999 |
| KR | 20-0322922 | Y1 | 8/2003 |
| KR | 20-0293688 | y1 * | 11/2017 |
| WO | 2012010122 | A2 | 1/2012 |

* cited by examiner

FAN HAVING COLD AIR FUNCTION

TECHNICAL FIELD

The present invention relates to a fan, and more particularly, to a fan having a cold air function that is capable of providing strong cold air through the supply of liquid oxygen LOX and that is capable of improving air purification effects and human body metabolism and obtaining eco-friendly effects through the supply of high purity oxygen.

BACKGROUND ART

Fans having a cold air function have been proposed in a conventional practice.

Referring first to Korean Utility Model Registration No. 20-0322922 (entitled 'cold air fan'), a given space is separately formed in the interior of the fan, and a thermal conductor disposed in the space is heated. Further, water is injected into the thermal conductor and is evaporated, and at this time, if surrounding temperature is lowered by the latent heat of the vaporization generated, the cold air is discharged to the outside, so that the air of the fan becomes cooler.

Further, there has been proposed Korean Utility Model Registration No. 20-0114832 (entitled 'dehumidification and cooling device of fan'), wherein a net body in which an ice pack is contained is disposed on the front side of the blades of the fan, and hot air is passed through the ice pack and is thus cold in summer, thereby blowing cold air. Further, in rainy season where humidity is high, air containing water is passed through the ice pack and is thus frozen, thereby removing the humidity from the air.

According to the conventional fans having the cold air function, however, their cooling effect is not high.

Besides, the conventional fans having the cold air function are complicated in structure and inconveniently need such heating process or cold source (ice pack) preparation (freezing) process for providing the cold air.

DISCLOSURE

Technical Problem

Accordingly, the present invention has been made in view of the above-mentioned problems occurring in the prior art, and it is an object of the present invention to provide a fan having a cold air function that is capable of providing strong cold air through the supply of liquid oxygen and that is capable of improving air purification effects and human body metabolism and obtaining eco-friendly effects through the supply of high purity oxygen.

Technical Solution

To accomplish the above-mentioned object, according to the present invention, there is provided a fan having a cold air function, the fan including a base part with a plurality of buttons disposed thereon, a main body part mounted on top of the base part, a motor part mounted on top of the main body part, rotary blades coupled to a motor shaft located on the front surface of the motor part, and a protection net adapted to surround the rotary blades therewith, wherein the fan includes: a mounting part for detachably mounting a liquid oxygen charge canister thereinto; an opening and closing controller for controlling the amount of oxygen gas discharged from the liquid oxygen charge canister mounted in the mounting part; and a discharge pipe connected to the opening and closing controller to allow the discharged oxygen gas to be emitted forwardly through the rotary blades.

According to the present invention, preferably, the liquid oxygen charge canister is made by compressing oxygen to a temperature of −183° C. or under and charging the compressed liquid oxygen thereto.

According to the present invention, preferably, the mounting part is located at the interior of the main body part.

According to the present invention, preferably, the protection net has a shape of a pipe and includes a plurality of horizontal net members, a rim net member, and a plurality of discharge holes formed on the front sides of the plurality of horizontal net members and the rim net member.

According to the present invention, preferably, the fan further includes a control circuit having an output adjuster adapted to control the opening and closing controller to control the amount of oxygen gas outputted, a switch part having at least a plurality of wind speed selection buttons, a cold air selection button, and a setting button, a motor driving part adapted to rotate a motor, and a controller adapted to set the cold air function according to the button input of the switch part, to output a motor driving signal corresponding to the wind speed selection inputted upon the selection of the cold air function to the motor driving part, and at the same time to output a control signal to the output adjuster so that the amount of the oxygen gas corresponding to the wind speed selected is supplied.

Advantageous Effects

According to the present invention, the fan having a cold air function is capable of providing strong cold air through the supply of liquid oxygen from the new type liquid oxygen charge canister.

According to the present invention, further, the fan having a cold air function is capable of supplying oxygen through the supply of the liquid oxygen upon the generation of the wind from the fan, thereby improving air purification effects and having good influences on the human body.

MODE FOR INVENTION

Hereinafter, an explanation on a fan having a cold air function according to the present invention will be given with reference to the attached drawing.

Figure 1:
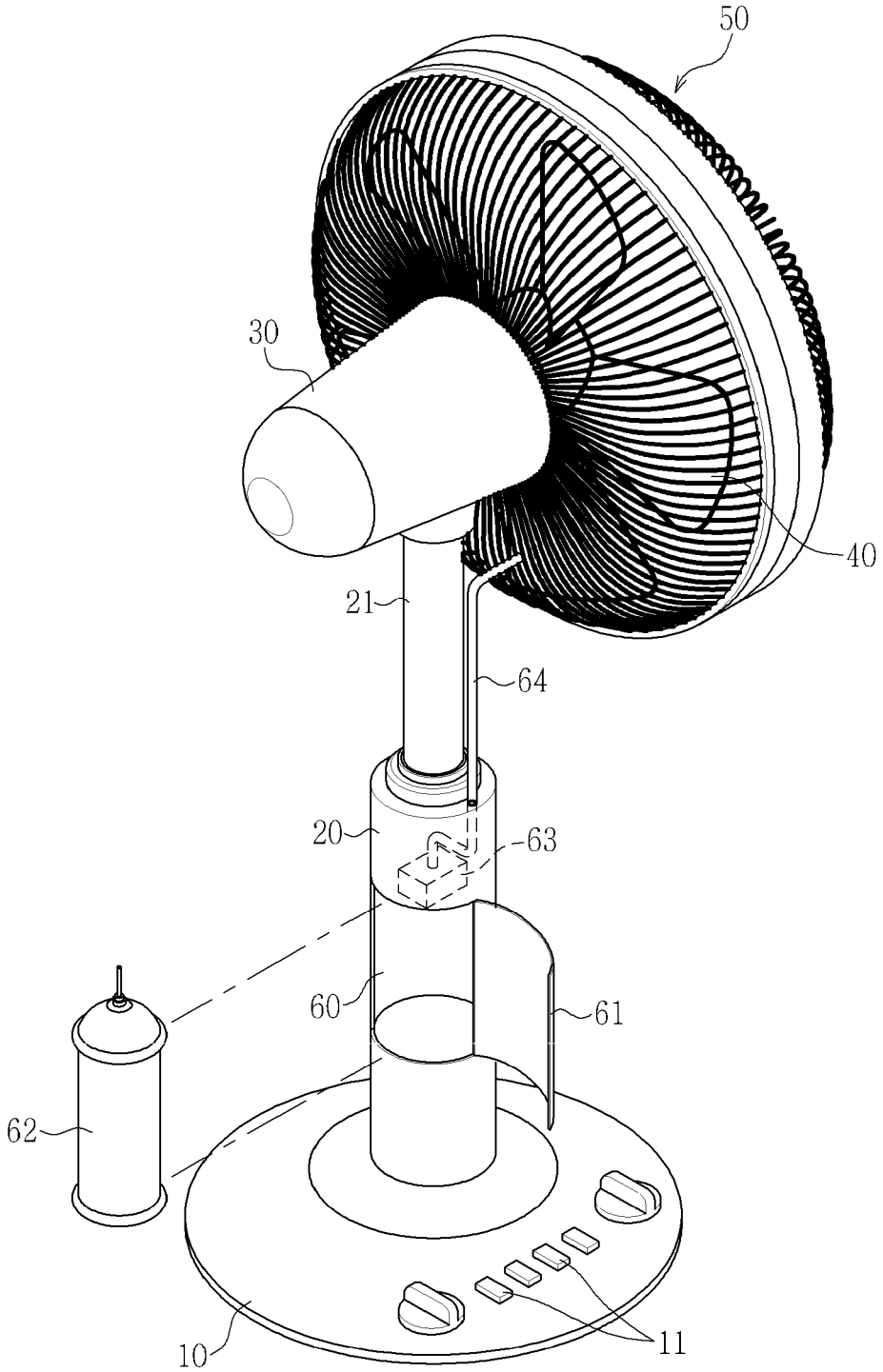
FIG. 1 is a perspective view showing a fan having a cold air function according to the present invention.

FIG. 1 is a perspective view showing a fan having a cold air function according to the present invention.

As shown, a fan having a cold air function according to the present invention generally includes a base part 10 with a plurality of buttons 11 disposed thereon, a main body part 20 mounted on top of the base part 10, an extension part 21 extendable from top of the main body part 20, a motor part 30 mounted on top of the extension part 21, rotary blades 40 coupled to a motor shaft located on the front surface of the motor part 30, and a protection net 50 adapted to surround the rotary blades 40 therewith, wherein the fan includes a mounting part 60 for detachably mounting a liquid oxygen (LOX) charge canister 62 (hereinafter, referred to as 'charge canister') thereinto; an opening and closing controller 63 for controlling the amount of oxygen gas discharged from the charge canister 62 mounted in the mounting part 60; and a discharge pipe 64 connected to the opening and closing controller 63 to allow the discharged oxygen gas to be emitted forwardly through the rotary blades 40.

According to the present invention, the new type liquid oxygen charge canister 62 is provided.

The liquid oxygen is light blue oxygen compressed to a temperature of −183° C. or under, which is charged to the charge canister 62 like a butane gas canister sold generally in the market.

Accordingly, the charge canister 62 has a discharge hole formed thereon to discharge the liquid oxygen charged therein to the outside, so that the oxygen gas having a substantially low temperature (−183° C.) is emitted, thereby providing strong cold air.

According to the present invention, further, the mounting part 60, which detachably mounts the charge canister 62 thereinto, is desirably located inside the main body part 20, but is not necessarily limited thereto.

The mounting part 60 may be located on the outer peripheral surface of the main body part 60, another portion of the fan, or a given portion separated from the fan.

The mounting part 60 has an openable/closable cover 61.

The opening and closing controller 63 is mounted on the discharge hole side of the charge canister 62 and includes a physical variable valve for controlling an amount of oxygen gas discharged by an electrical signal.

The discharge pipe 64 is extended from the interior of the main body part 20 in such a manner as to allow the discharge end thereof to be located behind the rotary blades 40, but is not necessarily limited thereto.

Figure 3:
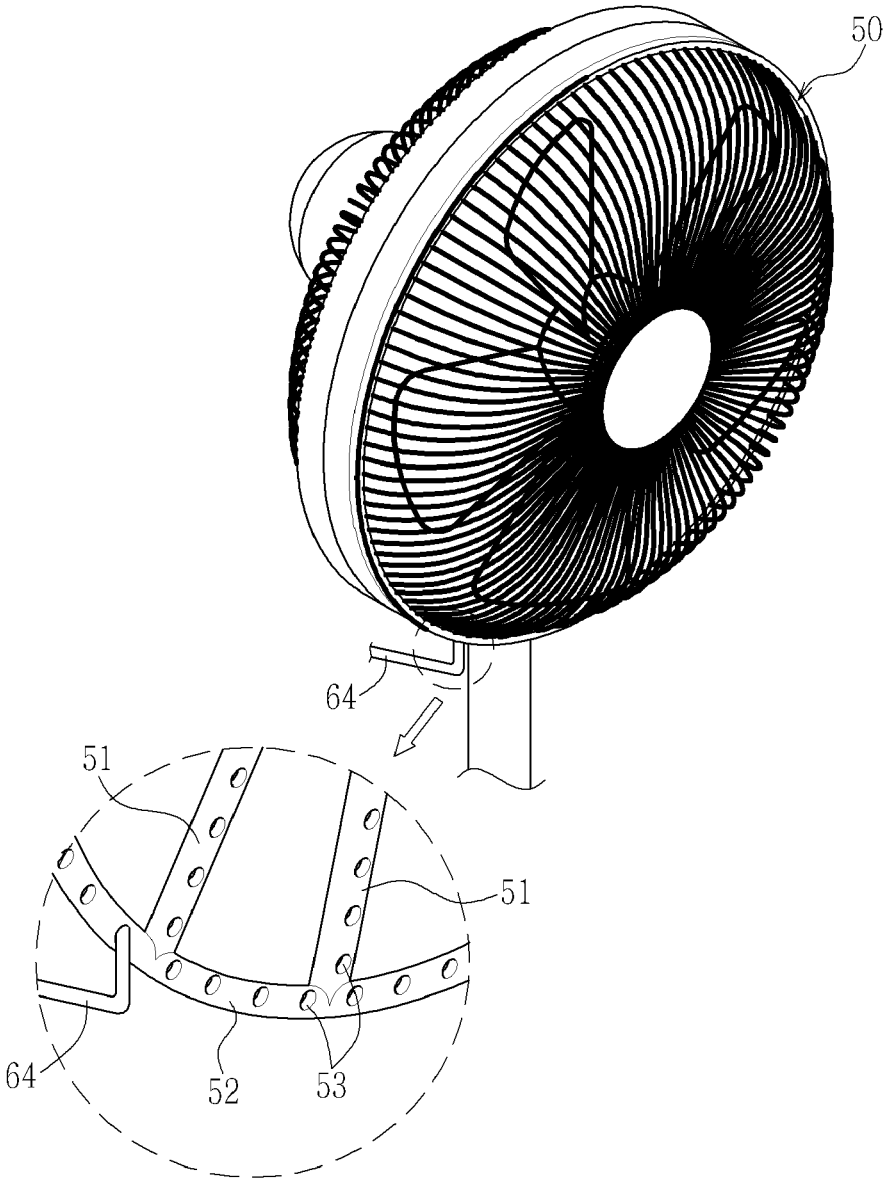
FIG. 3 is an enlarged view showing a protection net of the fan having a cold air function according to the present invention.

According to the present invention, as shown in FIG. 3, the protection net 50 may be made in the form of a pipe, so that a plurality of discharge holes 53 is formed on the front sides of a plurality of horizontal net members 51 and a rim net member 52.

Next, the discharge hole of the discharge pipe 64 is connected to one side of the pipe-shaped protection net 50, and through the discharge holes 53 formed on the protection net 50, accordingly, the oxygen gas can be emitted forwardly and dispersed uniformly.

Figure 2:
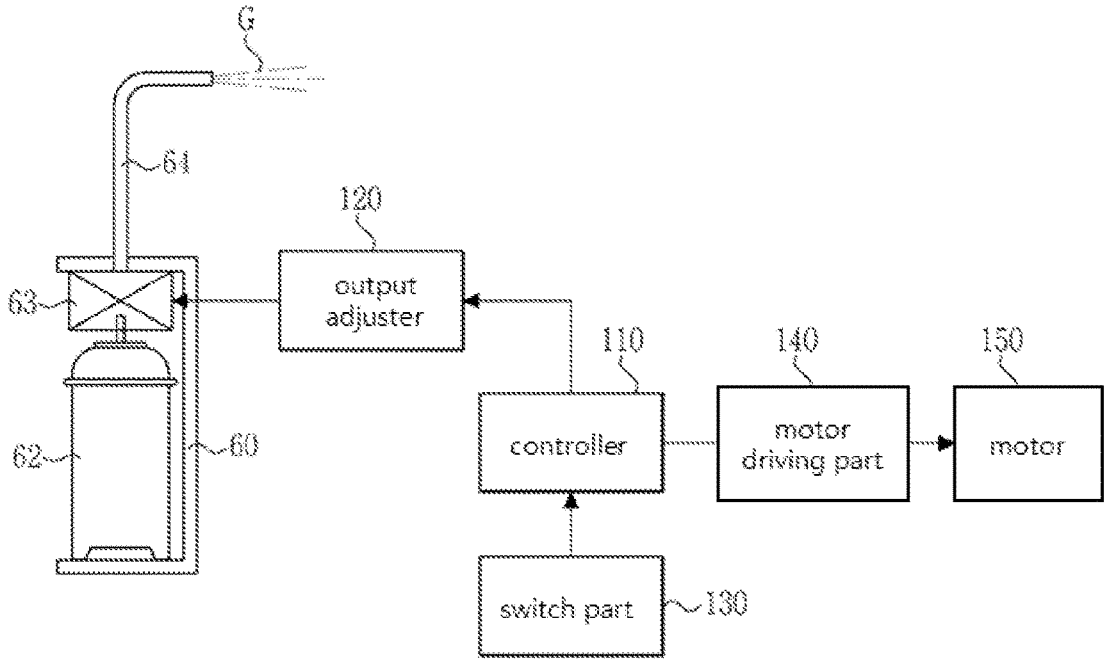
FIG. 2 is a block diagram showing a control circuit for the fan having a cold air function according to the present invention.

FIG. 2 is a block diagram showing a control circuit for the fan having a cold air function according to the present invention.

As shown, a control circuit for the fan having a cold air function according to the present invention includes a controller 110, an output adjuster 120, a switch part 130, a motor driver 140 and a motor 150.

The output adjuster 120 controls the opening and closing controller 63 under the control of the controller 110 to control the amount of oxygen gas outputted.

The switch part 130 has the plurality of buttons 11, and the plurality of buttons 11 has at least a plurality of wind speed selection buttons, a cold air selection button, and a setting button. The cold air selection button is a switch for selecting the cold air function.

If the cold air function is selected, the amounts of oxygen supplied are changed in accordance with the wind speed selection buttons selected.

If there are high, medium and low wind speed selection buttons, for example, large, medium and small amounts of oxygen supplied are varied in accordance with the wind speed selection buttons selected.

When the amounts of oxygen supplied are varied proportionally to the wind speeds, at this time, the cooling effect of the fan can be maximized.

The motor driving part 140 rotates the motor 150 under the control of the controller 110.

The controller 110 sets the cold air function according to the button input of the switch part 130, outputs a motor driving signal corresponding to the wind speed selection inputted upon the selection of the cold air function to the motor driving part 140, and at the same time outputs a control signal to the output adjuster 120 so that the amount of the oxygen gas corresponding to the wind speed selected is supplied.

According to the present invention, while driving the motor 150 stops, that is, while the rotary blades 40 are not driven, only the oxygen gas can be supplied through the buttons of the switch part 130.

Now, an explanation on the whole operation of the fan having the cold air function according to the present invention will be given.

First, the charge canister 62 is insertedly mounted into the mounting part 60 of the main body part 20.

At this time, the discharge hole of the charge canister 62 is kept coupled to the opening and closing controller 63. Next, the cover 61 is closed.

After that, power is supplied to the fan, and the cold air selection button of the switch part 130 is pressed.

If the cold air selection button is pressed, the controller 110 sets a cooling mode operation by the button signal inputted through the switch part 130.

If, for example, a medium wind speed selection button is pressed through the switch part 130, at this time, the controller 130 outputs a command corresponding to medium motor output to the motor driving part 140.

Accordingly, the motor driving part 140 drives the motor 150 with the medium output, so that the rotary blades 40 rotate at a medium speed.

At the same time, the controller 130 outputs a command corresponding to medium oxygen gas supply amount to the output adjuster 120, and the output adjuster 120 controls the opening and closing controller 63 so that the amount of gas outputted is adjusted to the medium output amount.

Accordingly, the liquid oxygen charged in the charge canister 62 is injected into the discharge pipe 64 through the opening and closing controller 63, and the oxygen gas discharged to the outside through the discharge pipe 64 is emitted forwardly behind the rotary blades 40 rotating together with the wind.

The liquid oxygen gas is cold air having a substantially low temperature and thus makes the wind blowing from the fan rapidly cooled, so that a cooling effect is provided and at the same time oxygen is supplied, thereby allowing a user to enjoy the cooling effect in optimal environments.

The invention claimed is:

1. A fan having a cold air function, comprising:

a base with a plurality of buttons disposed thereon, wherein the plurality of buttons include a switch having at least a plurality of wind speed selection buttons, a cold air selection button, and a setting button;

a main body mounted on top of the base;

a motor mounted on top of the main body and having a motor driver to rotate the motor;

rotary blades coupled to a motor shaft located on a front surface of the motor, and a protection net adapted to surround the rotary blades therewith;

a mounting for detachably mounting a liquid oxygen (LOX) charge canister thereinto;

an opening and closing controller to control an amount of cold oxygen gas discharged from the LOX charge canister, wherein the opening and closing controller includes a control circuit having an output adjuster to control the opening and closing controller to control the amount of oxygen gas outputted;

a discharge pipe connected to the opening and closing controller to allow the discharged cold oxygen gas to be emitted forwardly through the rotary blades, and a controller to set a cold air function according to the button input of the switch, to output a motor driving signal corresponding to a wind speed selection inputted upon the selection of the cold air function to the motor driver, and to output a control signal to the output adjuster so that an amount of the cold oxygen gas corresponding to the wind speed selected is supplied.

2. The fan according to claim 1, wherein the LOX charge canister contains liquid oxygen compressed to a temperature of −183° C. or lower.

3. The fan according to claim 1, wherein the mounting is located at the interior of the main body.

4. The fan having according to claim 1, wherein the protection net has a shape of a pipe and comprises a plurality of horizontal net members, a rim net member, and a plurality of discharge holes formed on front sides of the plurality of horizontal net members and the rim net member.

* * * * *